US011045388B2

(12) United States Patent
Salvarani

(10) Patent No.: US 11,045,388 B2
(45) Date of Patent: Jun. 29, 2021

(54) CONTAINER FOR FLUID PRODUCTS, PARTICULARLY FOR MEDICAL PRODUCTS, PHARMACEUTICALS, COSMETICS, FOOD OR THE LIKE

(71) Applicant: Lameplast S.P.A., Rovereto sul Secchia (IT)

(72) Inventor: Enrico Salvarani, Frazione Rovereto sul Secchia (IT)

(73) Assignee: Lameplast S.R.L.

( * ) Notice: Subject to any disclaimer, the term of this patent is extended or adjusted under 35 U.S.C. 154(b) by 469 days.

(21) Appl. No.: 16/099,193

(22) PCT Filed: May 18, 2017

(86) PCT No.: PCT/IB2017/052921
§ 371 (c)(1),
(2) Date: Nov. 6, 2018

(87) PCT Pub. No.: WO2017/199187
PCT Pub. Date: Nov. 23, 2017

(65) Prior Publication Data

US 2019/0201287 A1 Jul. 4, 2019

(30) Foreign Application Priority Data

May 20, 2016 (IT) ..... UA2016A003651

(51) Int. Cl.
*B65D 1/09* (2006.01)
*A61J 1/06* (2006.01)
*B65D 1/02* (2006.01)

(52) U.S. Cl.
CPC ..... *A61J 1/067* (2013.01); *B65D 1/095* (2013.01); *A61J 2205/30* (2013.01); *B65D 1/0246* (2013.01)

(58) Field of Classification Search
CPC .. B65D 1/095; B65D 1/0246; B65D 41/3447; A61J 1/06; A61J 1/067; A61J 2205/30
See application file for complete search history.

(56) References Cited

U.S. PATENT DOCUMENTS 6,234,333 B1 * 5/2001 Federighi ..... B65D 1/0238 215/48
2012/0285964 A1 * 11/2012 Weiler ..... B65D 1/095 220/276
2013/0098864 A1 * 4/2013 Fontana ..... B65D 1/0246 215/250

FOREIGN PATENT DOCUMENTS

EP 0918690 B1 2/2002
EP 2139659 1/2010
(Continued)

OTHER PUBLICATIONS

Decision to Grant dated Jun. 5, 2020 in corresponding European Application No. 17725362.2 and rsulting in EP Patent 3458368B1 granted Jul. 1, 2020.

(Continued)

*Primary Examiner* — Kai H Weng
(74) *Attorney, Agent, or Firm* — Polsinelli, P.C.

(57) ABSTRACT

The container (1) for fluid products, particularly for medical products, pharmaceuticals, cosmetics, food or the like, comprises:

a hollow body (2) for the containment of a fluid product having a neck (3);

a closing element (8) having an attachment portion (9) which, in a closing configuration, is associated with the hollow body (2) along a preset breaking line (10) adapted to allow the separation of the closing element (8) from the hollow body (2) in a separation configuration wherein on the hollow body (2) is formed an opening for the outflow of the fluid product;

(Continued)

at least a flap element (11) for supporting information, data or logos (12), joined to the attachment portion (9) and movable between an initial configuration wherein the flap element (11) is moved away from the neck (3), and a final configuration wherein the flap element (11) is fitted at least partially around the neck (3) to form a maneuver key (13) adapted to allow the removal by tearing the closing element (8) off.

10 Claims, 2 Drawing Sheets

(56) References Cited

FOREIGN PATENT DOCUMENTS

| | | | |
|---|---|---|---|
| WO | 2007107826 | A2 | 9/2007 |
| WO | WO 2007/107826 | | 9/2007 |
| WO | 2007144741 | A1 | 12/2007 |
| WO | WO 2009/019527 | | 2/2009 |

OTHER PUBLICATIONS

Office Action in related Indian patent application No. 102016000052392 dated Feb. 1, 2021.

International Search Report and the Written Opinion dated Aug. 14, 2017 From the International Searching Authority Re. Application No. PCT/IB2017/052921. (10 Pages).

* cited by examiner

CONTAINER FOR FLUID PRODUCTS, PARTICULARLY FOR MEDICAL PRODUCTS, PHARMACEUTICALS, COSMETICS, FOOD OR THE LIKE

Related Applications

This application is a National Phase of PCT Patent Application No. PCT/IB2017/052921 having International filing date of May 18, 2017, which claims the benefit of priority of Italian Patent Application No. UA2016A003651 filed on May 20, 2016. The contents of the above applications are all incorporated by reference as if fully set forth herein in their entirety.

Field and Background of the Invention

The present invention relates to a container for fluid products, which is particularly adapted to contain products used in the medical, pharmaceutical, cosmetic, food sector or the like.

With particular reference to the pharmaceutical and/or cosmetic industries it is known to use containers made of polymeric material for the packaging of one or more doses of fluid, liquid or pasty products.

The known containers can be of the resealable or disposable type and generally comprise a containment body of a predetermined dose of product, with a substantially tubular and elongated shape, which has one ending part provided with a neck, on top of which a product dispensing spout is defined.

The opposite ending part of the containment body is provided with an opening adapted to the introduction of the product, which is closed after filling, e.g., by sealing.

Closing means, associable in a removable manner with the containers at the neck, allow for the occlusion of the dispensing spout.

The containment body and the closing means can be made separately, using forming techniques such as injection molding, and then assembled together, or, alternatively, they can be made in a single body piece and then separated before use by a user.

The containment body is also provided with a pair of tabs which are adapted to facilitate the grip of the container by a user, and which extend, diametrically opposite to each other, from the outer lateral surface of the containment body itself.

The known containers can be produced in single units or associated with each other in series to form a so-called "strip"; in the latter case the tabs of the containment bodies of two subsequent containers are temporarily associated with each other at easily tearable weakened-section connection lines, which allow separating one container from the other.

With particular reference to the closing means and to their conformation, different types of containers are known according to the different modes of use and realization.

A first type of known containers provides, e.g., for the use of a closing element which, in the molding step, is carried out with a portion fixed to the neck of the container along predetermined breaking areas, to occlude the dispensing spout.

In other words, the containment body and the closing element are made in a single body piece so that the dispensing spout of the container is initially closed and can be opened by tearing off the closing element from the containment body.

Possibly, the closing element can also comprise a cap-like seat, which is arranged on the opposite side with respect to the portion initially fixed to the neck and which is provided with a shutter body of suitable dimensions to be able to be introduced into the dispensing spout.

In this case the container is opened for the first time by detaching the closing element from the dispensing spout at the breaking areas and, after use of the product, the container can be re-closed by overturning the closing element and by fitting the cap-like seat onto the neck, with the positioning of the shutter body inside of the dispensing spout.

Containers of this type are shown in patent documents EP 0326529 B1 and EP 2190750 B1.

A second type of re-closable containers made in a single body piece comprises closing means equipped with a shutter element, of the type of a cap or the like, inserted in a sealing manner inside the dispensing spout, and deformable or breakable elements which connect, without interruption, the closing means to the container body.

These deformable or breakable elements are adapted to indicate to the user the possible presence of product contaminations due to any tampering and/or to the fortuitous opening of the product, and therefore performing the function of a warranty seal.

Containers of this kind are shown in patent document EP 2139659 B1.

A third type of containers is also known, in which the closing means and the containment body are made in separate pieces, subsequently assembled together.

The closing means of such containers generally comprise a handle provided with a shutter element, of the type of a cap or the like, insertable in a sealing manner inside the dispensing spout, and an annular collar fixable coaxially and interlocking at the neck of the containment body.

The handle is associated in a removable manner at the outer surface of the collar by means of a suitable weakened area, composed, e.g., of pre-fracture lines, breakable bridges, reduced cross sections or the like.

The handle, the collar and the cap are then made in a single body piece, separately from the containment body, and the collar is subsequently fixed to the neck by interlocking, by closing the dispensing spout with the cap.

Containers of this kind are shown in patent document EP 1289842 B1.

These known containers, however, are susceptible of further improvements.

In particular, as a result of increasingly stringent and restrictive European and American standards, product-related information on each individual container is mandatory (instead of on the entire strip and in addition to those commonly indicated on the packaging and/or on additional printed material).

This requirement is even more felt in the case of strips composed of containers containing different products, wherein the completeness and clarity of the information entered at each container is of paramount importance.

The information, which may comprise, e.g., information on the product dosage, its packaging and/or expiry date, or the like, is generally found on the gripping tabs of the containers, by printing or application of labels or the like.

The ever greater need to include as much information as possible, in a clearly legible manner, is however counterbalanced by the reduced portions of usable surface on the gripping tabs.

The remaining portions of the containers are not generally suitable for the inclusion of such information, due to the presence of special reliefs, shaping or edging.

To this is added the fact that the legislative regulations of some countries are even more restrictive for particular types of fluid products, such as those intended for oral administration, and require that in these cases the information may not be printed directly on the product containment body, to avoid that the ink may pass through the walls of the container and pollute the fluid product, reducing even more the available surfaces.

To obviate at least in part these drawbacks the patent documents WO 2007/107825 A2 and WO 2007/107826 A2 teach how to make containers having a substantially plate-like closing element on which an adhesive label is applied showing the required information.

In this embodiment, however, the presence of the plate-like element leads to an increase in the volumetric dimensions occupied by the container inside the respective packaging.

Summary of the Invention

The main aim of the present invention is to provide a container for fluid products, particularly for medical products, pharmaceuticals, cosmetics, food or the like, on which it is possible to add all the required product-related information, in a clear and legible manner.

Another object of the present invention is to provide a container for fluid products, particularly for medical products, pharmaceuticals, cosmetics, food or the like, the volumetric dimensions of which are reduced by a value equal to approximately 20% if compared with containers of known type having equal containing capacity.

A further object of the present invention is to provide a container for fluid products, particularly for medical products, pharmaceuticals, cosmetics, food or the like, which allows to overcome the mentioned drawbacks of the prior art within the ambit of a simple, rational, easy, effective to use and low cost solution.

The above mentioned objects are achieved by the present container for fluid products, particularly for medical products, pharmaceuticals, cosmetics, food or the like, according to claim 1.

Brief Description of the Several Views of the Drawings

Other characteristics and advantages of the present invention will become more evident from the description of a preferred but not exclusive, embodiment of a container for fluid products, particularly for medical products, pharmaceuticals, cosmetics, food or the like, illustrated by way of an indicative, but non-limiting example in the accompanying drawings, wherein.

Figure 1:
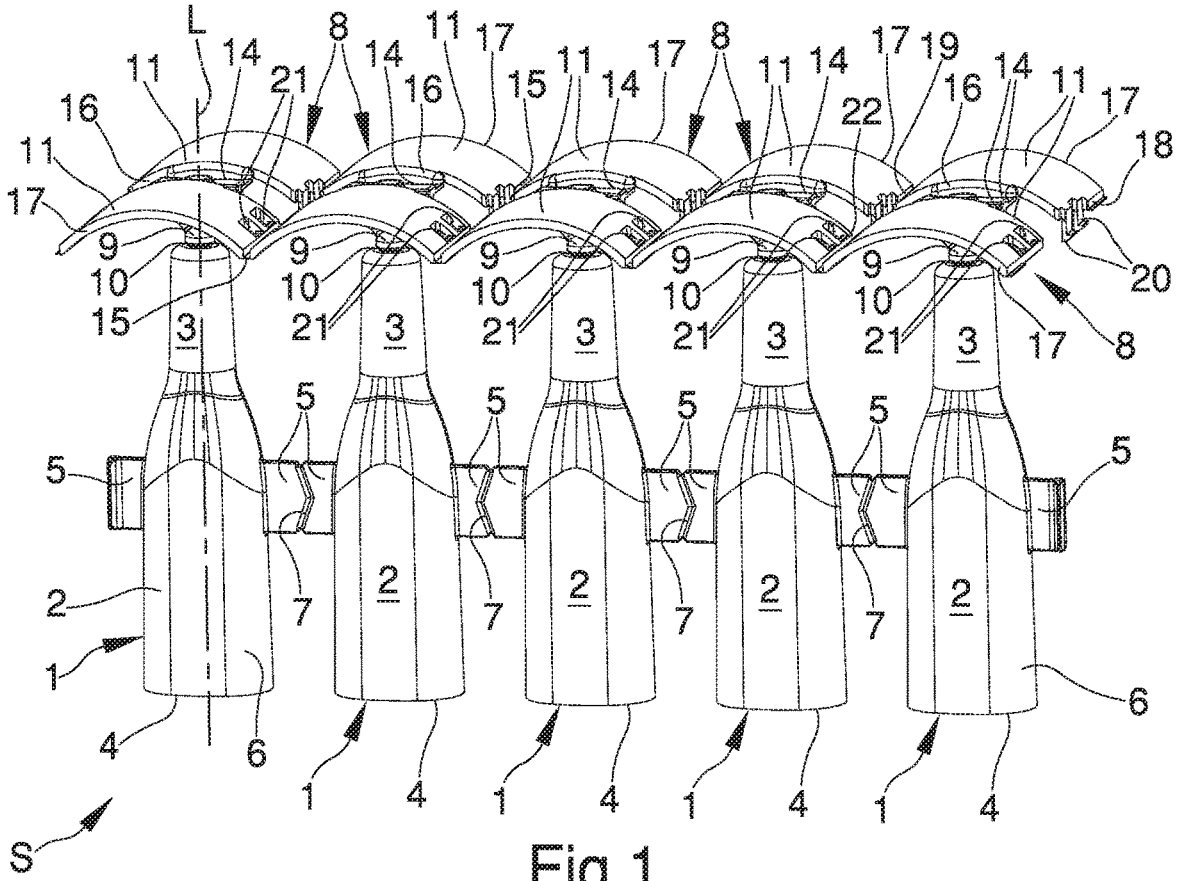
FIG. 1 is an axonometric view of a strip of containers according to the invention in the initial configuration.

Description of Specific Embodiments of the Invention

With particular reference to such figures, letter S globally designates a strip of containers 1 for fluid products, particularly for medical products, pharmaceuticals, cosmetics, food or the like.

In this respect, it is specified that in this discussion by the term "fluid products" not only liquid products are meant but also viscous products, e.g. in the state of paste and gel, and powdery products, in particular very fine powders with great smoothness.

Each container 1 comprises a hollow body 2 for the containment of a fluid product having a neck 3.

The neck 3 has a substantially axial-symmetric shape with a circular cross section, with a smaller diameter than the rest of the hollow body 2.

The shape of the neck 3, in particular, is substantially frusto-conical and ends up into a constant section cylindrical portion, with coaxial alignment with respect to the hollow body 2; alternative embodiments cannot however be ruled out in which the walls of the neck 3 have different shape and, for example, are not coaxial to the hollow body 2.

In addition, the container 1 is provided with a bottom portion 4 opposite to the neck 3.

The hollow body 2 extends substantially elongated along a corresponding longitudinal axis L; in this respect it is emphasized that in the present discussion the term "longitudinal" is used with reference to the direction of greater extension of the hollow body 2.

Each container 1 comprises at least one gripping tab 5 defined as protruding from the lateral surface 6 of the hollow body 2.

As can be seen in the figures, each container 1 comprises two gripping tabs 5 defined, with respect to the longitudinal axis L, on diametrically opposite portions of the hollow body 2.

The gripping tabs 5, in fact, are associated along a first weakened area 7 with the gripping tab 5 of another container 1 arranged adjacent to form the strip S of containers 1.

In addition, the container 1 comprises a closing element 8 provided with an attachment portion 9 which, in a closing configuration (FIGS. 1 and 2), is associated with the hollow body 2 along a preset breaking line 10.

If necessary, the attachment portion 9 can be shaped so as to define at least one shutter element insertable into the outflow opening, in such a way as to allow the re-closing of the container 1 for uses subsequent to the first one.

In detail, the shutter element is the type of a pin which extends in a cantilever fashion from the attachment portion 9 and is coaxial to the longitudinal axis L.

Preferably, the preset breaking line 10 is formed on the neck 3.

Within the ambit of the present discussion, by the term "preset breaking line" is meant an area of the containers 1 having a weakened section and is, therefore, easily tearable.

The preset breaking line 10 is adapted to allow the separation of the closing element 8 from the hollow body 2 so as to define a separation configuration wherein on the hollow body 2 is formed an outflow opening, not visible in the figures, of the fluid product.

In this case, the outflow opening is formed on the neck 3; this means that the hollow body 2 ends up in the neck 3, the lateral surface 6 of which defines the margins of the outflow opening itself.

Each container 1, in practice, is made integral in a single body piece in the aforementioned closed configuration by means of, e.g., a manufacturing process by injection molding which will be described in more detail in the remainder of this discussion.

After filling the hollow body 2 with the fluid product and sealing the outflow opening, each container 1 is intended to be opened by a user only shortly before use, by tearing off the preset breaking line 10 and separating the closing element 8 from the hollow body 2.

The container 1 comprises at least one flap element 11 for supporting information, data or logos 12, which is joined to the attachment portion 9 and movable between an initial configuration (FIG. 1) wherein the flap element 11 is moved away from the neck 3, and a final configuration (FIG. 2) wherein the flap element 11 is fitted at least partially around the neck 3 to form a maneuver key 13 adapted to allow the removal by tearing off the closing element 8.

With reference to the particular embodiment shown in the figures, the container 1 comprises two flap elements 11.

Alternative embodiments cannot also be ruled out in which the container 1 comprises three, four, etc. flap elements 11.

Each flap element 11 comprises a support surface having a substantially curvilinear profile.

In detail, each flap element 11 is delimited by a first side 16 and a second side 17 substantially parallel to a folding line 14 formed on the attachment portion 9, and by a third side 18 and a fourth side 19 which extend substantially transversely to the folding line 14.

Preferably, the first side 16 is associated with the attachment portion 9, and the second side 17 is opposite to the first side 16.

Each flap element 11 is associated along a second weakened area 15 with the flap element 11 of another container 1 arranged adjacent to form the strip S of containers 1.

In the initial configuration the flap elements 11 are arranged substantially transversely to the longitudinal axis L passing through the neck 3, and in the final configuration the flap elements 11 are associated with each other on opposite sides with respect to the neck 3.

In this case, in the final configuration, the flap elements 11 are substantially parallel to the longitudinal axis L.

The passage of the flap elements 11 from the initial configuration to the final configuration is facilitated by the folding line 14 which is provided substantially parallel to a holding plane of the container 1.

With reference to the particular embodiment shown in the figures, each container 1 comprises two folding lines 14 formed on the attachment portion 9 on opposite sides with respect to the longitudinal axis L.

Within the ambit of the present discussion, by the term "folding line" is meant an elastically deformable area of the attachment portion 9 and which, therefore, by folding without breaking, is adapted to facilitate the passage of the flap elements 11 from the initial configuration to the final configuration.

In the final configuration, the flap elements 11 are associated with each other by interposition of hooking means 20, 21 adapted to join flush the respective outer surfaces.

The hooking means 20, 21 comprise at least one tooth element 20 associated with one of the flap elements 11, and at least a housing seat 21 made on the other flap element 11 and adapted to house the tooth element 20 to lock the flap elements 11 in the final configuration.

With reference to the particular embodiment shown in the figures, each pair of flap elements 11 comprises four tooth elements 20 and, at the same time, four housing seats 21.

In this case, two tooth elements 20 are formed in the proximity of the third side 18 of a flap element 11, and two tooth elements 20 are formed in the proximity of the fourth side 19 of the other flap element 11.

Similarly to the tooth elements 20, also the housing seats 21 are made in twos in the proximity of the third side 18 and of the fourth side 19, respectively.

As can be seen in the figures, the housing seats 21 are through holes inside which each tooth element 20 engages by interlocking and stops up against a corresponding abutment side 22 of the housing seat 21.

The interlocking of the tooth elements 20 inside the housing seat 21 is adapted to prevent the flap elements 11 from mutually moving away; this way the information, data or logos 12 supported by the flap elements 11 remain always available and can be consulted by the user even when the container 1 is opened.

The operation of the present invention is as follows.

Figure 2:
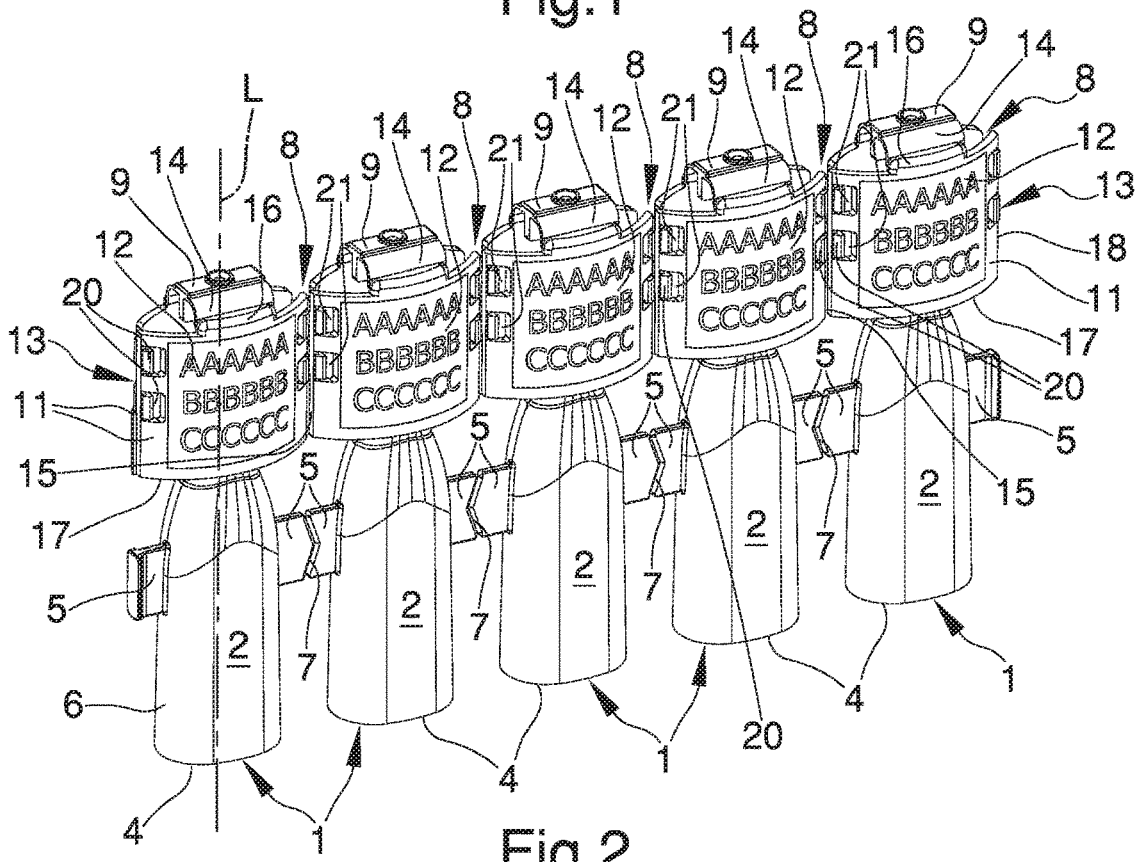
FIG. 2 is an axonometric view of a strip of containers according to the invention in the final configuration.
Figure 4:
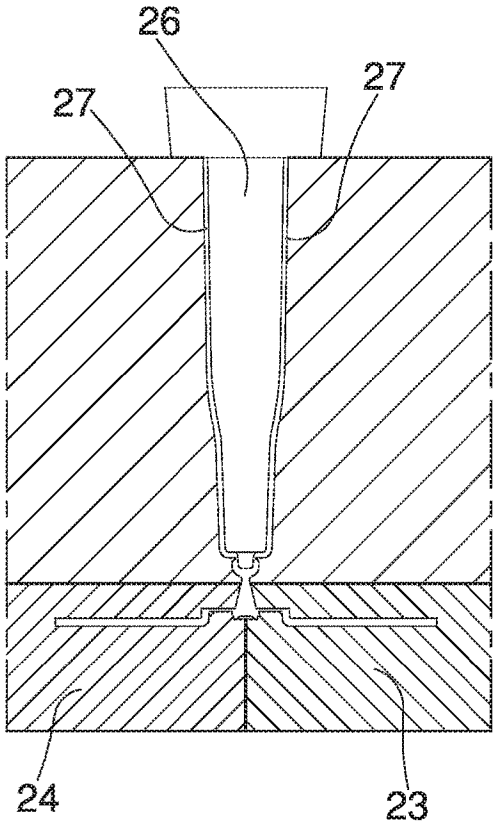
FIG. 4 is a sectional view along the plane IV-IV of FIG. 3.
Figure 3:
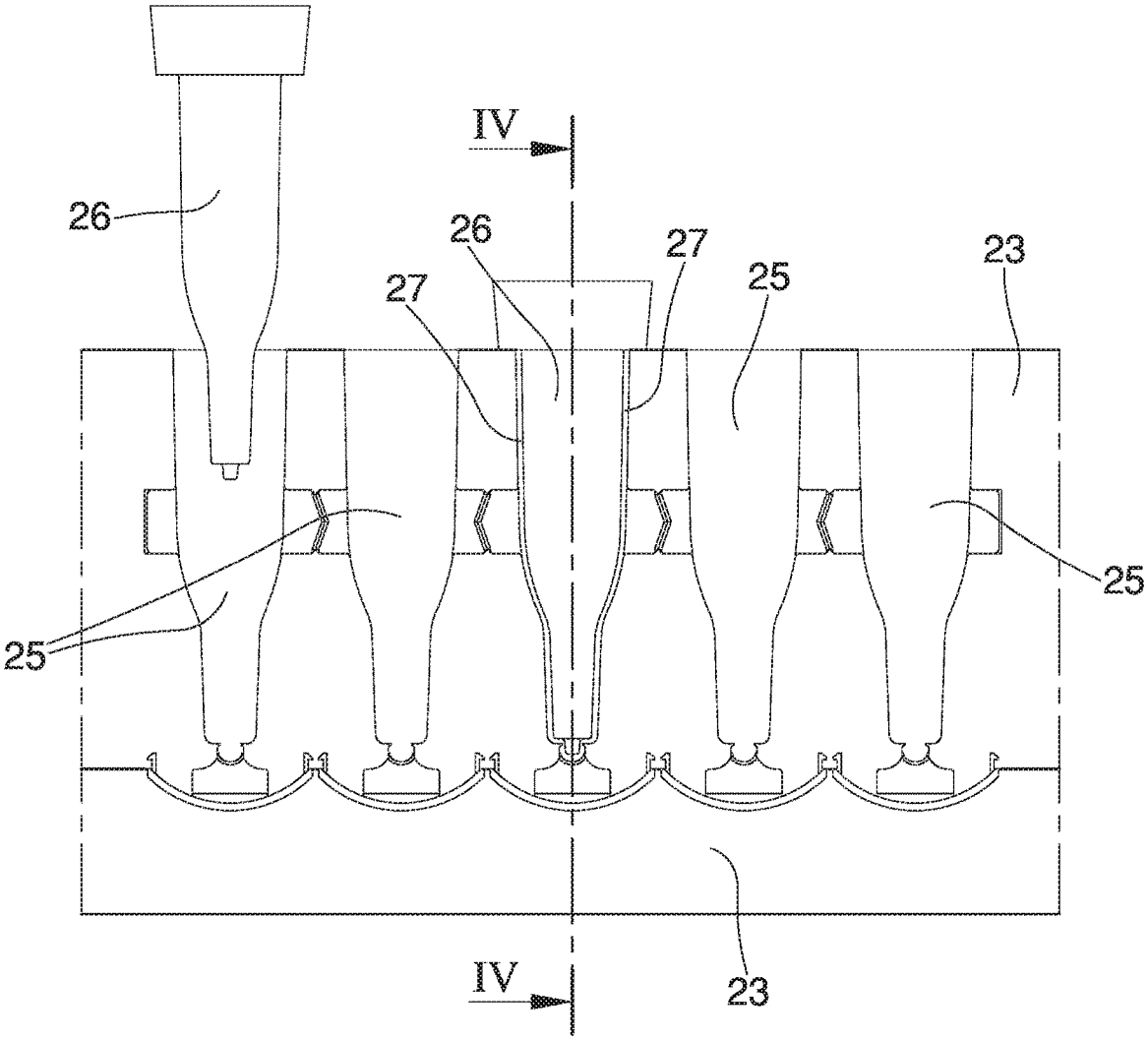
FIG. 3 is a front, schematic and partial view of the forming station of the strip of containers according to the invention.

Starting from the initial configuration (FIG. 1), the flap elements 11 are lowered and associated with each other to form the maneuver key 13 (FIG. 2).

Each tooth element 20 locked inside the respective housing seat 21 ensures the maintenance of the final configuration during the packaging, storage, transport and use operations of the container 1.

At the time of use, the user moves the closing element 8 away from the hollow body 2 by tearing the preset breaking line 10 off.

During this operation, the maneuver key 13 is grasped by the user and, by exploiting the partial deformability in centripetal direction of the same, is removed to form the outflow opening of the fluid element.

The present invention also relates to a process for the manufacture of containers for fluid products, particularly for medical products, pharmaceuticals, cosmetics, food or the like.

The process comprises a plurality of steps. In this case, the first step consists in forming at least a container 1 having:

- the hollow body 2 for the containment of a fluid product and having the neck 3;
- the closing element 8, in turn, having the attachment portion 9 which, in a closing configuration, is associated with the hollow body 2 along the preset breaking line 10 adapted to allow the separation of the closing element 8 from the hollow body 2 in a separation configuration wherein on the hollow body 2 is formed the outflow opening of the fluid product.

Preferably, the first step is carried out by injection molding of plastic material inside a forming mold 23, 24.

The forming mold 23 consists, e.g., in a first half-shell 23 and in a second half-shell 24, separable from each other and having recesses 25 which can be mutually coupled, for forming corresponding portions of the surface of the containers 1.

Inside the forming mold 23 is inserted a plurality of inner cores 26 adapted to define an inter-space 27 for forming the strip S of containers 1 in a single body piece.

The forming mold 23 and the inner cores 26 are shaped in such a way that, during the forming inside the inter-space 27, the closing element 8 of the containers is arranged with the flap elements 11 substantially transverse, in particular orthogonal, to the lying plane of the containers 1.

The process continues with a second step which consists in realizing at least one flap element 11 for supporting the information, data or logos 12.

Specifically, the above mentioned realization step is carried out during the step of formation of the hollow body 2, of the neck 3 and of the closing element 8; this means that the injection molding inside the forming mold 23, 24 allows for the realization of the container 1 in a single monolithic body.

Preferably, in the aforementioned process two flap elements 11 are realized.

The flap elements 11 are joined to the attachment portion 9.

The flap elements 11 are made in the initial configuration in which they are moved away from the neck 3.

At this point, the process comprises a third step which consists in moving each flap element 11 from the initial configuration to the final configuration in which the flap elements 11 are fitted at least partially around the neck 3 to form the maneuver key 13 adapted to allow the tearing off of the closing element 8.

The above mentioned movement occurs by means of the application of forces on the flap elements 11.

The application of forces can take place by means of a movement of the forming mold 23, 34, or in a mechanical manner, namely through the use of a special machine.

The next step of the process involves filling the hollow body 2 with the fluid product with the outflow spout closed by the closing element 8.

In particular, at the bottom portion 4 of the hollow body 2 is defined an introduction spout of the fluid product; the closing of the introduction spout (e.g. by sealing the lips of the opening itself) is made after introducing the fluid product, before placing the container on the market.

It is pointed out that in all the figures shown in the accompanying drawings, the spout and its use to fill the hollow body 2 with the fluid product are never represented in detail; for simplicity of representation all the containers illustrated in the figures are to be understood as already filled with the fluid product and ready to be opened to allow dispensing.

After filling the hollow body 2, the process continues with the step of sealing the edge of the hollow body 2 itself between two sealing elements.

The sealing is carried out by means of heating and/or ultrasounds; in both cases, the plastic material that makes up the containers is heated at the sealing elements, softening the material and determining the adhesion thereof when the lips of the pressed edges come in mutual contact.

The sealed portions, in this case the gripping tabs 5 and the second weakened area 15 which are obtained this way, extend substantially coplanar to the lying plane of the strip S.

Finally, the process comprises a final step which consists in applying information, data or logos 12 on each flap element 11 in the final configuration.

To mark information, data or logos 12 onto the support surface, for example, screen printing, marking, padding or printing techniques on plastics may be used.

Alternative embodiments cannot however be ruled out in which information, data or logos 12 are applied on the support surface of the flap elements 11 by means of an adhesive label.

It cannot be ruled out the step of applying information, data or logos 12 occurs before the filling step.

It has in practice been observed that the described invention achieves the intended objects.

In particular the fact is stressed that the particular solution to provide two flap elements movable between an initial configuration in which they are substantially transverse to the lying plane of the container and a final configuration in which the flap elements define a maneuver key allows a reduction in the volumetric dimensions of the container itself by a value equal to approximately 20%.

The fact should also be considered that the maneuver key makes a support surface available on which all the required product-related information can be added, in a clear, legible manner and always visible to the user.

The invention claimed is:

1. Container (1) for fluid products, including medical products, pharmaceuticals, cosmetics comprising:

at least a hollow body (2) for the containment of a fluid product having at least a neck (3);

at least a closing element (8) having at least an attachment portion (9) which, in a closing configuration, is associated with said hollow body (2) along a preset breaking line (10) adapted to allow the separation of said closing element (8) from said hollow body (2) in a separation configuration wherein on said hollow body (2) is formed an opening for the outflow of said fluid product;

wherein said container (1) comprises at least one flap element (11) for supporting information, data or logos (12), joined to said attachment portion (9) and movable between an initial configuration wherein said flap element (11) is moved away from said neck (3), and a final configuration wherein said flap element (11) is fitted at least partially around said neck (3) to form a maneuver key (13) adapted to allow removal by tearing said closing element (8) off.

2. Container (1) according to claim 1, wherein said container (1) comprises at least two flap elements (11).

3. Container (1) according to claim 1, wherein in said initial configuration said flap elements (11) are arranged substantially transversely to a longitudinal axis (L) passing through said hollow body (2), and in said final configuration said flap elements (11) are associated with each other on opposite sides with respect to said neck (3).

4. Container (1) according claim 1, wherein, in said final configuration, said flap elements (11) are associated with each other by interposition of hooking means (20, 21) adapted to join flush outer surfaces thereof.

5. Container (1) according to claim 4, wherein said hooking means (20, 21) comprise at least a tooth element (20) associated with one of said flap elements (11), and at least a housing seat (21) formed on the other flap element (11) and adapted to house said tooth element (20) to lock said flap elements (11) in said final configuration.

6. Container (1) according to claim 1, wherein said container (1) comprises at least a folding line (14) formed on said attachment portion (9), substantially parallel to a holding plane of said container (1) and adapted to allow the passage, as a result of the application of forces, of said flap elements (11) from said initial configuration to said final configuration.

7. Container (1) according to claim 1, wherein said container (1) comprises at least a gripping tab (5) defined as protruding from a lateral surface (6) of said hollow body (2).

8. Container (1) according to claim 7, wherein said gripping tab (5) is associated along a first weakened area (7) with the gripping tab (5) of another container (1) arranged adjacent to form a strip (S) of containers (1).

9. Container (1) according to claim 8, wherein each of said flap elements (11) is associated along a second weakened area (15) with the flap element (11) of another container (1) arranged adjacent to form said strip (S) of containers (1).

10. Strip (S) of containers for fluid products, including medical products, pharmaceuticals, cosmetics, wherein said strip (S) comprises a plurality of containers (1) according to claim 1.

* * * * *